US005871113A

United States Patent [19]

Conway et al.

[11] Patent Number: 5,871,113

[45] Date of Patent: Feb. 16, 1999

[54] LID FOR A CONTAINER

[75] Inventors: William J. Conway, Moorpark; Frank Merriweather, Jr., Carson, both of Calif.

[73] Assignee: Bodrick Washroom Equipment, Inc., North Hollywood, Calif.

[21] Appl. No.: 926,658

[22] Filed: Sep. 10, 1997

[51] Int. Cl.[6] ..... B65D 55/14

[52] U.S. Cl. ..... 220/210; 220/284; 220/326

[58] Field of Search ..... 220/210, 284, 220/324, 326; 215/207, 216

[56] References Cited

U.S. PATENT DOCUMENTS

| | | | |
|---|---|---|---|
| 1,055,797 | 3/1913 | Redding | 220/210 X |
| 3,930,388 | 1/1976 | Barras | 220/210 X |
| 4,673,100 | 6/1987 | Reis et al. | 220/324 |
| 5,464,109 | 11/1995 | Greenwald | 220/210 X |
| 5,577,779 | 11/1996 | Dangel | 220/326 X |

*Primary Examiner*—Stephen K. Cronin
*Attorney, Agent, or Firm*—Pretty, Schroeder & Poplawski

[57] ABSTRACT

A lid for a container having an open top with a rear wall having a snap slot and a hook slot, the lid having a latch mechanism with a snap member and a hook member projecting downward for positioning in the snap slot and the hook slot, respectively, when the lid is in position on the container, and having a key slot adjacent the snap and hook members. Each of the snap member and the hook member has a cam surface adjacent the key slot for engagement by a key member pushed downward through the key slot to pivot the snap and lock members away from the snap and hook slots, respectively, for removal of the lid from the container. The hook member has an upward and rearward projecting hook adjacent the lower end of the hook member for entering the container hook slot, and the snap member has a rearward projecting shoulder adjacent the lower end of the snap member for entering the container snap slot.

12 Claims, 6 Drawing Sheets

40
39
41
15
12
25
18
20
50
3
24
21
16
4
4

2
2
12
18
13
14
19
11
17

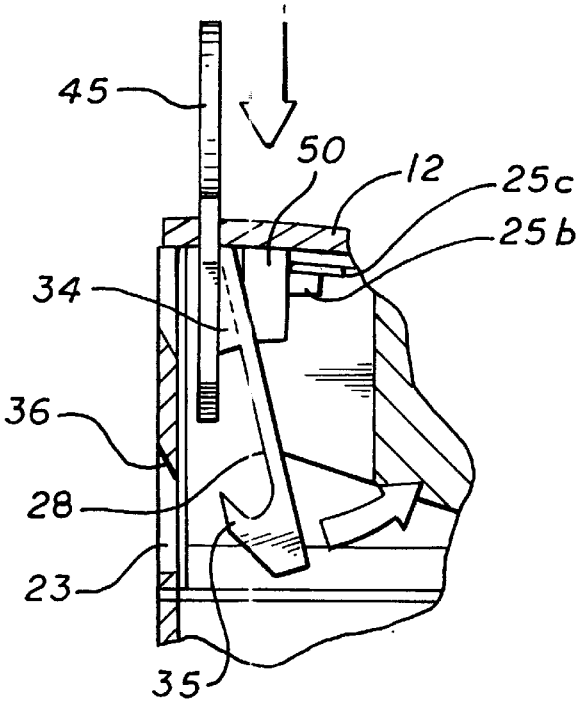
FIG. 3
FIG. 4
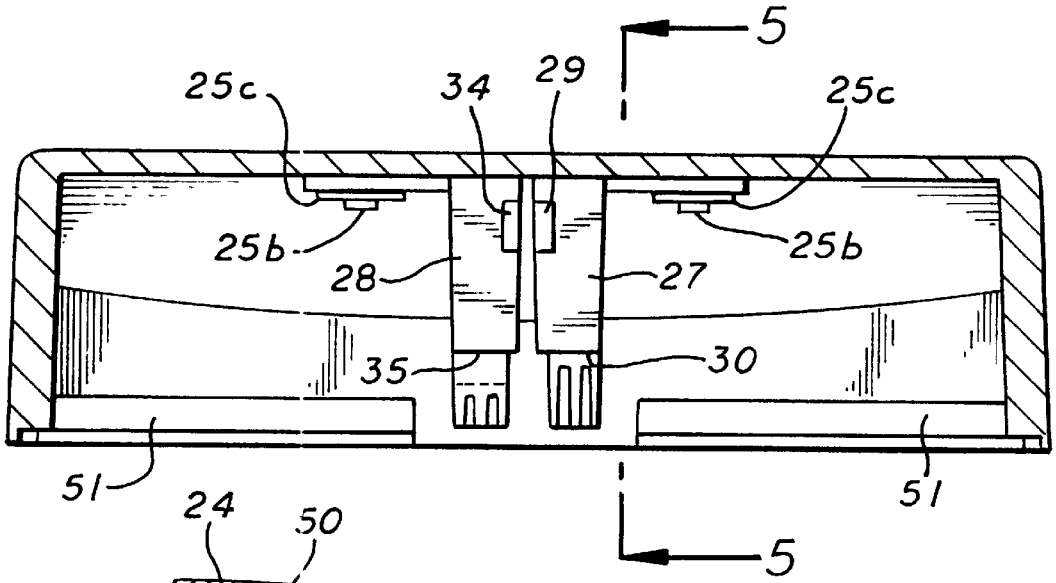
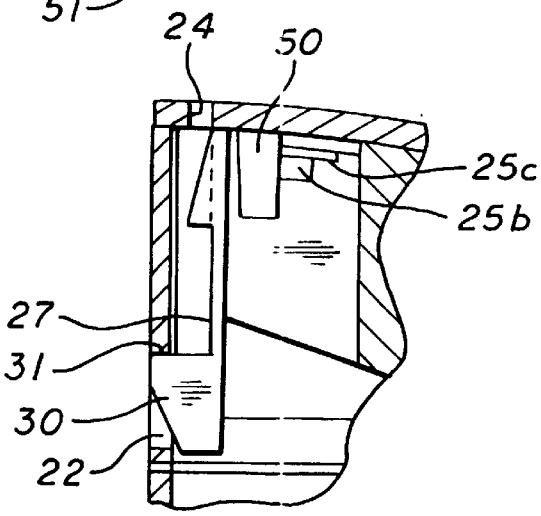
FIG. 5

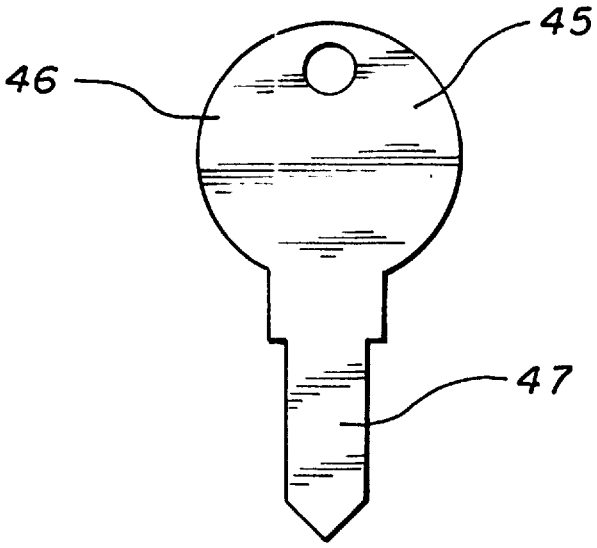
FIG. 6
FIG. 7
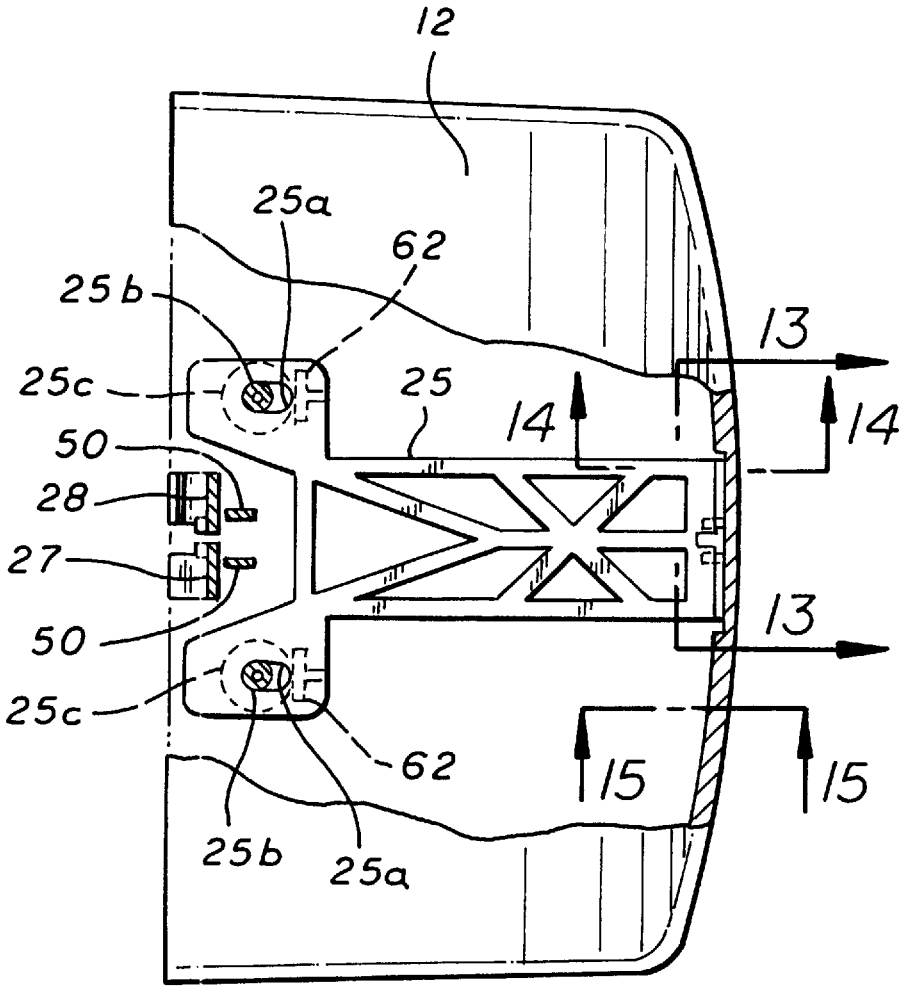

FIG. 10
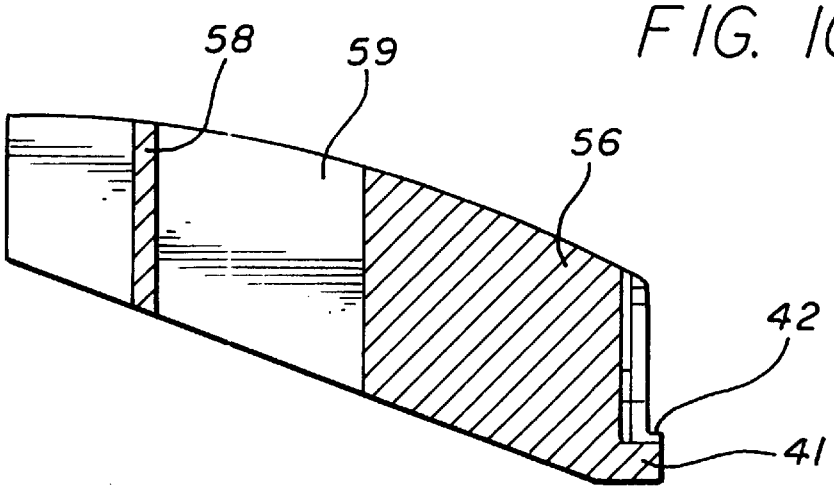
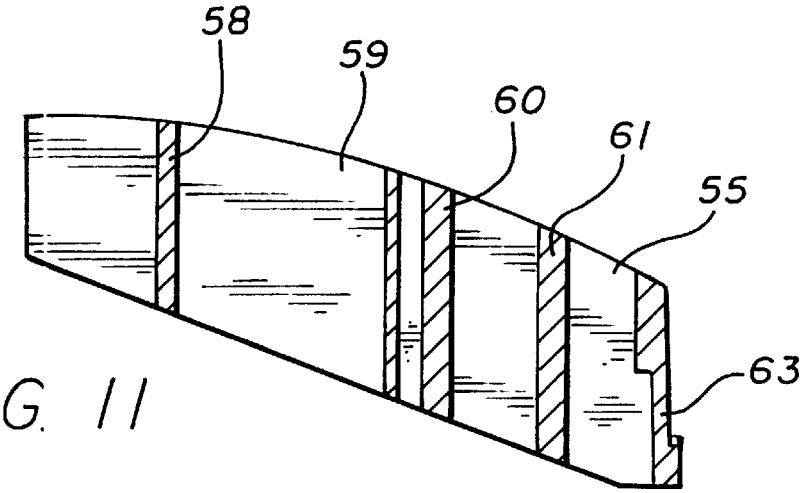
FIG. 11
FIG. 12
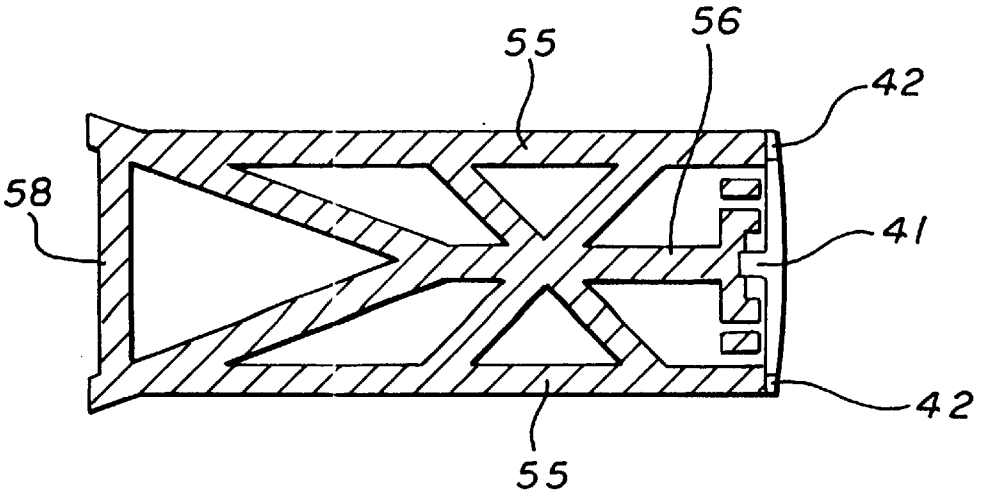

FIG. 13
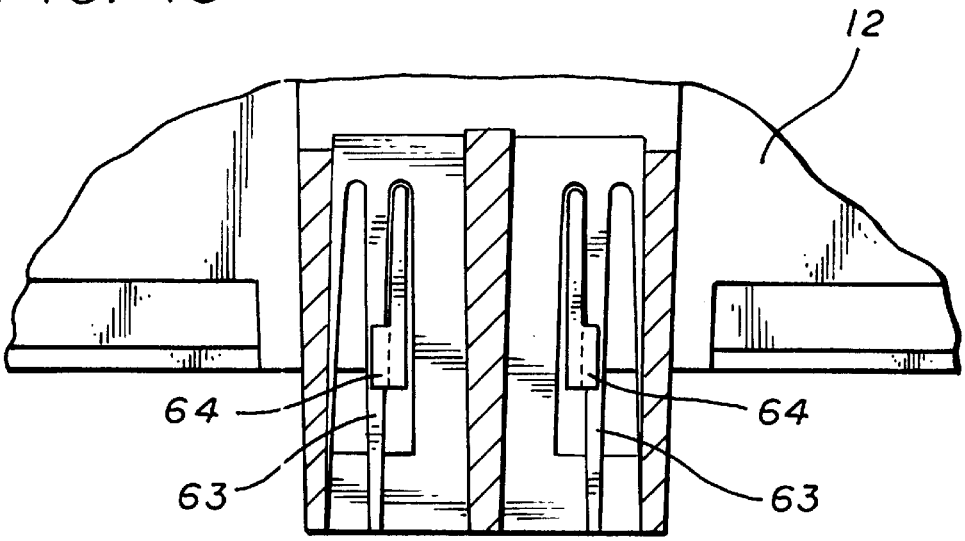
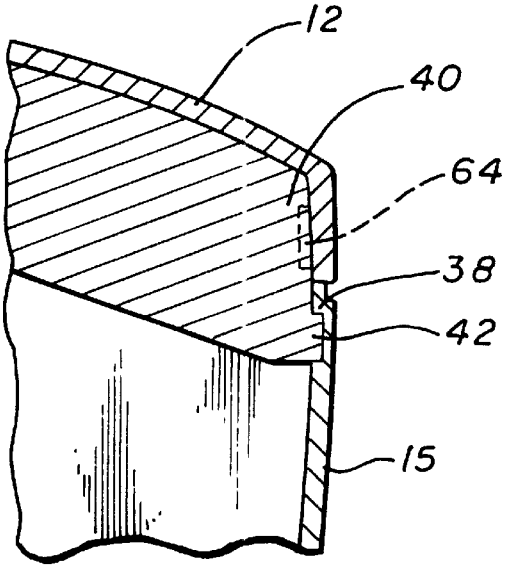
FIG. 14
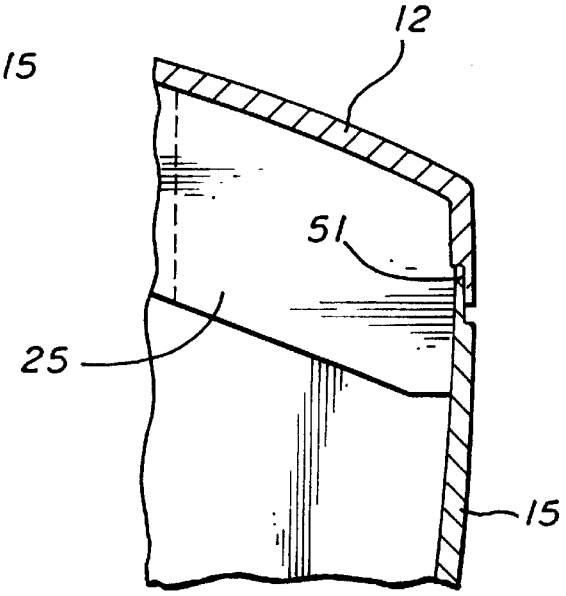
FIG. 15

LID FOR A CONTAINER

BACKGROUND OF THE INVENTION

This invention relates to new and improved lids for containers, and is especially suited for use with plastic molded containers and lids. Containers of this type are widely used, one example being in dispensers for soaps and lotions in public washrooms.

Containers of this nature require ease of access for refilling, while at the same time providing a degree of security for protection from vandalism and the like. Another desirable feature of such lids and containers is that the products be relatively inexpensive and at the same time durable. Since containers of this type ordinarily are filled by relatively low skilled employees, the procedure and equipment required for removing and replacing lids needs to be simple, yet effective.

SUMMARY OF THE INVENTION

Accordingly, it is an object to the present invention to provide a new and improved lid for a container which overcomes the disadvantages of the prior constructions and which provides the desirable performance features as discussed above.

In particular, it is an object of the invention to provide a lid and container connection construction which incorporates both a snap operation for a snug fit of the lid on the container and a hook operation which provides a secure connection which resists the conventional squeezing and/or pulling efforts ordinarily associated with removing a lid from a container.

The invention includes a lid for a container having an open top with a rear wall having a snap slot and a hook slot, the lid having a latch mechanism with a snap member and a hook member projecting downward for positioning in the snap slot and the hook slot of the container, respectively, when the lid is in position on the container, the lid also having a key slot adjacent the snap and hook members, with each of the snap member and the hook member having a cam surface adjacent the key slot for engagement by a key member pushed downward through the key slot to pivot the snap and lock members away from the snap and hook slots, respectively, for removal of the lid from the container.

Preferably in the invention the hook member has an upward and rearward projecting hook adjacent the lower end of the hook member for entering the container hook slot, and the snap member has a rearward projecting shoulder adjacent the lower end of the snap member for entering the container snap slot. Further, the hook slot has a downward and forward directed upper surface for mating with the projecting hook of the hook member, and the snap slot has a horizontal upper surface for engagement with the shoulder of the snap member.

Also desirably the invention includes a key member having a handle with a projecting tab, with the key slot of a size to receive the tab while blocking movement of the handle into the key slot. Desirably, the container has a forward wall with an upper edge and a rearwardly projecting lip at the upper edge, and the lid has a forward wall with a lower edge and a forwardly projecting tab for engaging the lip when the container is closed by the lid.

BRIEF DESCRIPTION OF THE DRAWINGS

FIG. 3 is an enlarged view of the portion of FIG. 2 enclosed by the phantom line 3;

FIG. 4 is a partial sectional view taken along the line 4—4 of FIG. 2;

FIG. 5 is a partial sectional view taken along the line 5—5 of FIG. 4;

FIG. 6 is a side view of a key member suitable for use with the lid and container of the invention;

FIG. 7 is a top view of the lid with a portion broken away to show details of the interior of the lid, including the lid frame;

FIG. 10 is a sectional view taken along the line 10—10 of FIG. 8;

FIG. 11 is a sectional view taken along the line 11—11 of FIG. 8;

FIG. 12 is a sectional view taken along the line 12—12 of FIG. 9;

FIG. 13 is an enlarged sectional view taken along the line 13—13 of FIG. 7;

FIG. 14 is a partial sectional view similar to that of FIG. 2, taken along the line 14—14 of FIG. 7; and FIG. 15 is a partial sectional view similar to those of FIGS. 2 and 14, taken along the line 15—15 of FIG. 7.

DESCRIPTION OF THE PREFERRED EMBODIMENT

Figure 1:
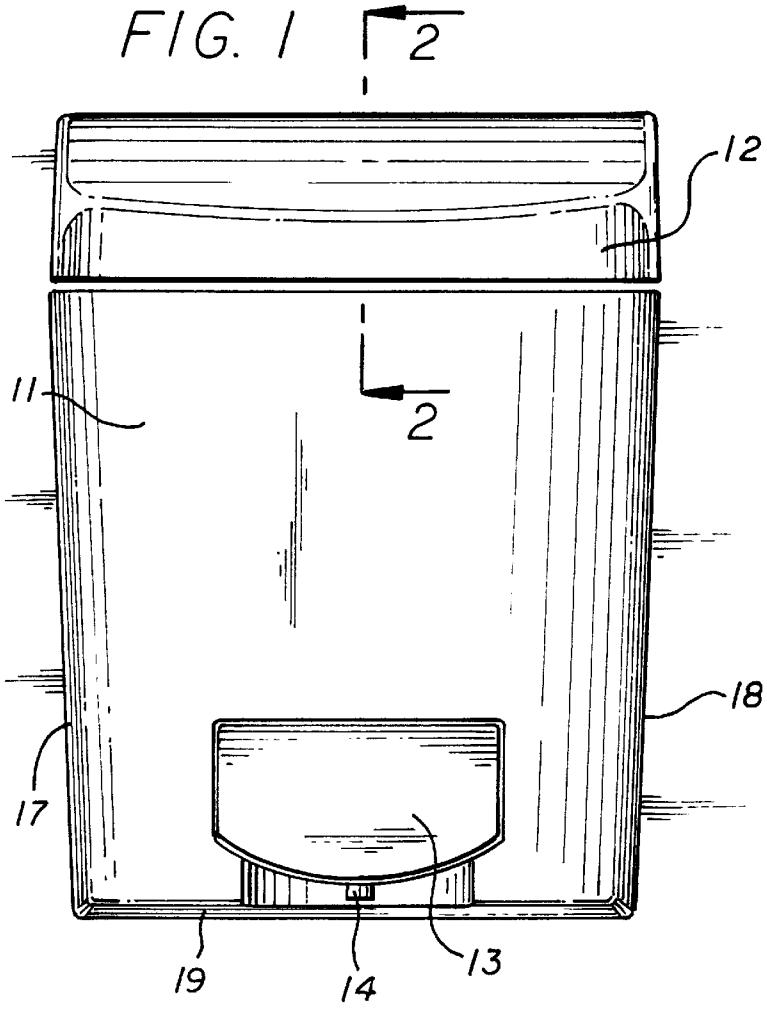
FIG. 1 is a front view of a soap dispenser with container and lid incorporating the presently preferred embodiment of the invention.
Figure 8:
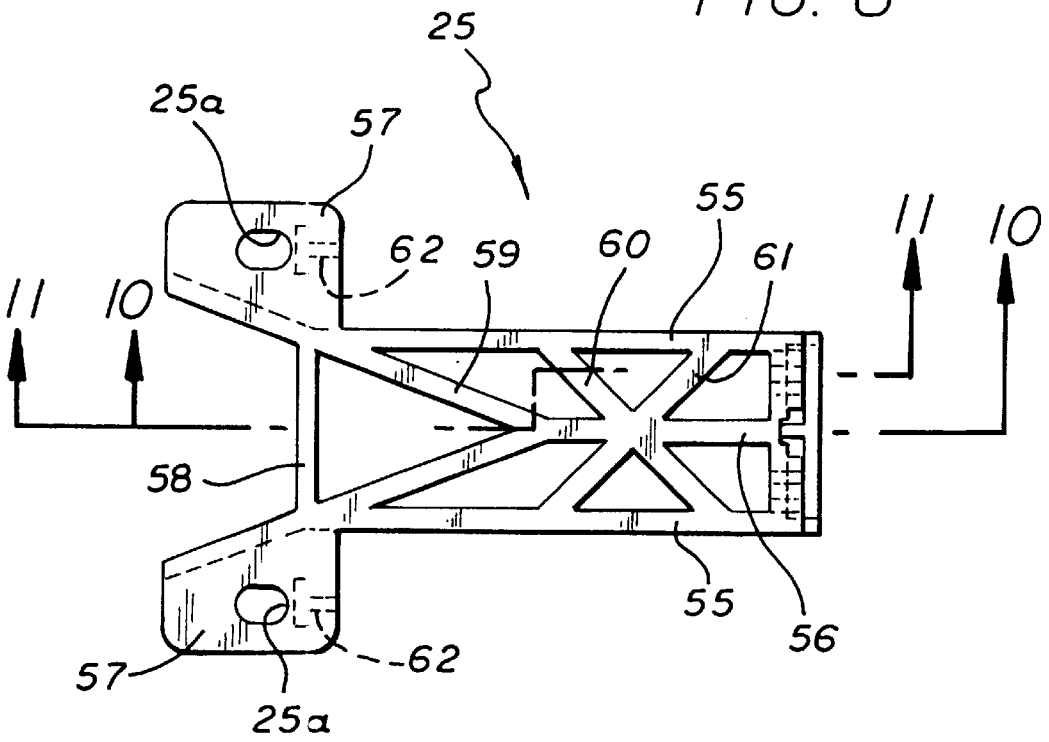
FIG. 8 is a bottom view of the lid frame.
Figure 9:
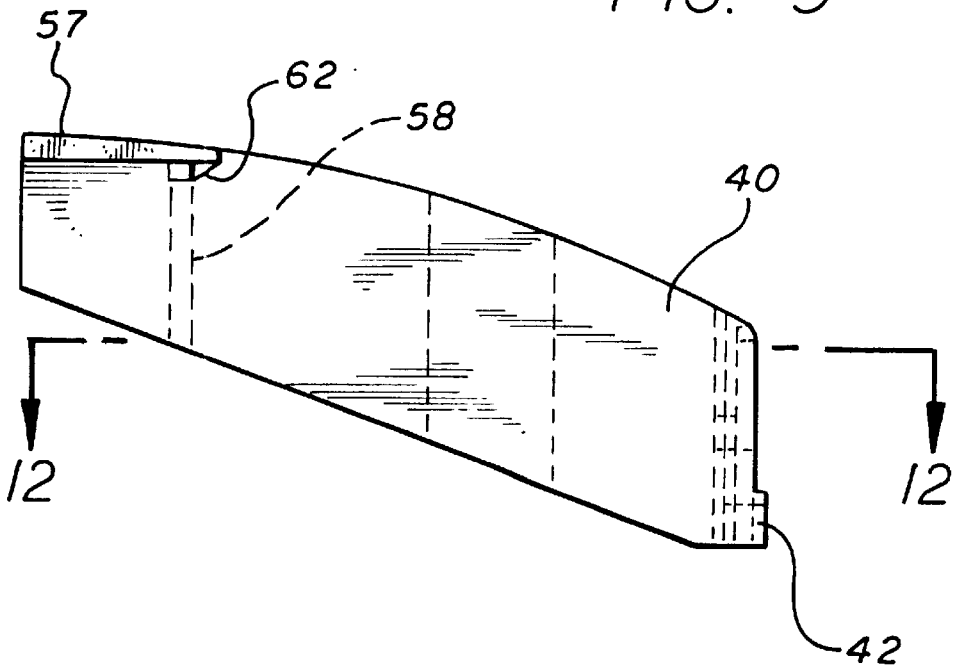
FIG. 9 is a side view of the lid frame.

Referring to FIG. 1, a container 11 is shown with a lid 12. The specific container illustrated is for a soap dispenser, and includes a push button 13 and an outlet spout 14 for the liquid soap. Typically this soap dispenser is mounted on the wall of a washroom in the usual manner. Of course the present invention is suitable for use with containers for all manner of products.

The container has a front 15, a back 16, sides 17, 18 and a bottom 19 joined together to provide the container. The container has an open top 20 which is closed by the lid 12.

The back of the container has an upper portion 21 with a snap slot 22 and a hook slot 23 therein. A key slot 24 is provided in the upper surface of the lid adjacent the rear.

A frame 25 is carried on the underside of the lid and forms a part of the lid. Typically the frame is held in place in the lid by two snaps in front, and with the frame positioned by openings 25*a* in the frame on bosses 25*b* in the lid. A retaining clip 25*c* is placed on each boss 25*b* to secure the frame to the lid. See FIG. 7. A similar construction is shown in FIGS. 4 and 5.

A snap member 27 and a hook member 28 are carried on the inner surface of the top of the lid, adjacent the rear. The snap member 27 has a cam surface 29 adjacent the upper end of the snap member, and also has a rearward projecting shoulder adjacent the lower end. In the embodiment illustrated, one such shoulder 30 is utilized. The snap slot 22 has a horizontal upper surface 31, for engagement by the shoulder 30 of the snap member when the lid is in place on the container, as seen in FIG. 5.

Figure 2:
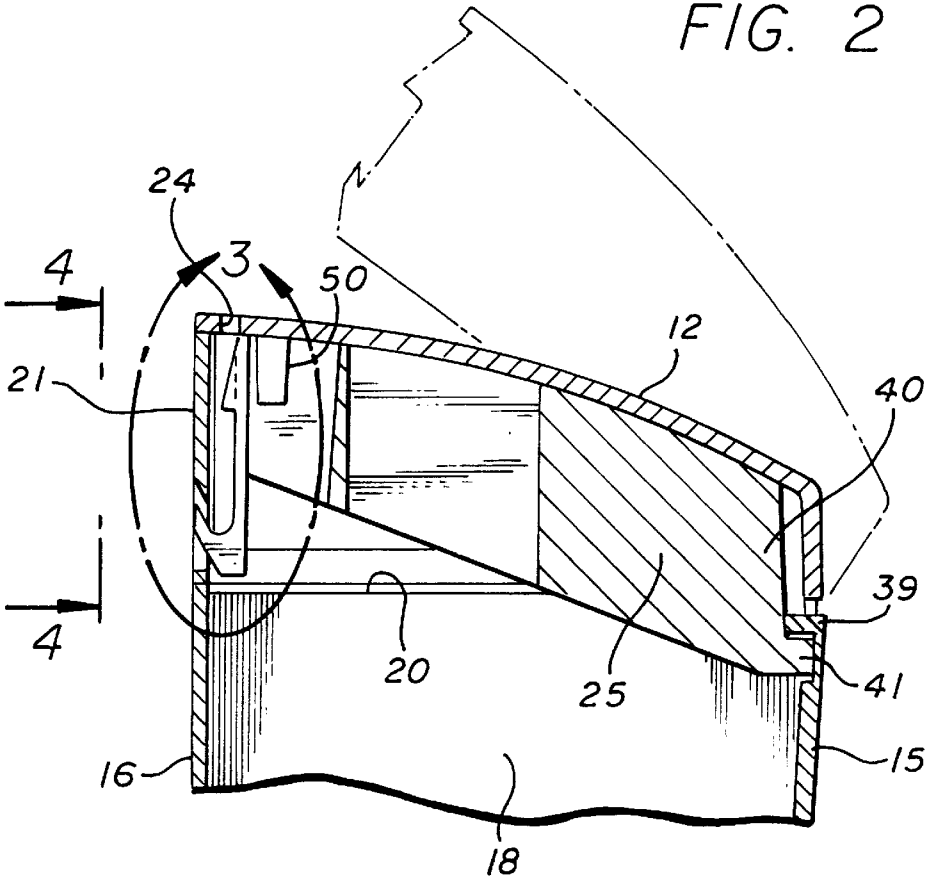
FIG. 2 is an enlarged partial view taken along the line 2—2 of FIG. 1.

The hook member 28 includes a cam surface 34 adjacent the upper end of the hook member, and an upward and rearward projecting hook 35 for positioning in the hook slot 23 of the container. Preferably the hook slot 23 has a downward and forward directed upper surface 36 for engagement by the projecting hook 35 of the hook member. One such hook 35 is shown in FIG. 4. This construction is seen in FIGS. 2 and 3. The slots in shoulder 30 and hook 35 are for molding purposes only, eliminating a build up of plastic that would adversely affect the molding.

Referring to FIGS. 2 and 14, the front 15 of the container has an inwardly directed deep lip 39 and two shallow lips 38. The front 40 of the frame 25 of the lid 12 has one deep tab 41 and two shallow tabs 42 which fit under the lips 38 and 39 when the lid is in position on the container, as shown in solid lines in FIG. 2. The shallow lips holds the shallow tabs tight once assembled.

Downward projecting tabs 50 are carried on the underside of the lid, behind the snap member and hook member, to prevent the snap and hook members from deflecting too far when the key is inserted. Too much deflection will cause the snap and hook members to be over stressed and crack.

The frame 25 for the lid is shown in greater detail in FIGS. 8–12. The frame is formed of parallel side members 55 with a parallel center member 56 and two mounting flanges 57, all joined by cross members 58, 59, 60 and 61. Typically the frame is a plastic molding. Stop tabs 62 (FIG. 8) are provided on the underside of the mounting flanges 57 for the purpose of helping prevent the frame 25 from moving back if a force is applied to the tabs 41 and 42 on the frame 25. The retaining clips on the bosses 25*b*, when assembled, are right against the stop tabs, preventing this movement.

The strips 63 seen in FIG. 13 flex to the side and snap behind hook members or ribs 64 on the inside front of the lid 12.

In operation, the lid is placed on the container by engaging the tabs 42 of the lid 12 under the lips 38 and 39 of the container, in the position shown in FIGS. 2 and 14. Then the lid is pivoted counterclockwise downward onto the container. The snap and hook members have tapered lower surfaces so that they flex forward as the lid is pushed downward onto the container, permitting the lid to be positioned on the container. Recessed areas 51 are provided in the lid for overlapping the upper portion of the vessel on the front to help prevent a person from pushing on the front of the lid or squeezing the sides of the vessel and disengaging the tabs on the lid from the lip on the vessel. See FIG. 15.

When the lid is in position on the container, the snap member 27 engages the snap slot 22 and holds the lid snug on the container. The hook member 28 is positioned in the hook slot 23, but the hook 35 preferably does not engage the lower surface 36 of the hook slot, being in the position shown in FIG. 2.

A key member 45 has a handle 46 and a tab 47. To remove the lid from the container, the tab 47 of the key is pushed downward through the key slot 24 and engages the cam surfaces of the snap member and hook member, as seen in FIG. 3. This engagement pivots the hook member away from the back wall out of the hook slot and also pivots the snap member forward out of the snap slot. The lid then is readily pivoted upward to the position of FIG. 2 permitting a slight rearward motion of the forward end of the lid to disengage the lid tabs 41, 42 from under the container lips 38, 39.

A person attempting to remove the lid without utilizing the key member can apply considerable force on the lid and container. These two components, preferably plastic moldings but also if made of metal, will flex and persistent significant force can cause the snap member to move out of the snap slot, ordinarily freeing the lid for upward motion. However, in the construction of the invention, the small upward motion of the lid brings the hook into engagement with the lower surface of the hook slot and restricts further upward motion of the lid. Unless significant force is applied sufficient to fracture the hook member, the lid can be removed only by utilizing a key member for engaging the cam surfaces.

Considerable force can cause the two shallow tabs to move out of the shallow lip. The center deep tab will still be engaged under the deep lip, preventing the lid from being removed. The lid will also move forward, maintaining the engagement of the lips and tabs.

We claim:

1. A lid for a container, said container having an open top with a rear wall having a snap slot and a hook slot, said lid having a latch mechanism with a snap member and a hook member projecting downward for positioning in said snap slot and said hook slot, respectively, when said lid is in position on said container, a key slot in said lid adjacent said snap and hook members, each of said snap member and said hook member having a cam surface adjacent said key slot for engagement by a key member pushed downward through said key slot to pivot said snap and lock members away from said snap and hook slots, respectively, for removal of said lid from said container.

2. A lid as defined in claim 1 with said hook member having an upward and rearward projecting hook adjacent the lower end of said hook member for entering said container hook slot.

3. A lid as defined in claim 2 with said snap member having a rearward projecting shoulder adjacent the lower end of said snap member for entering said container snap slot.

4. A lid as defined in claim 3 wherein said hook slot has a downward and forward directed upper surface for mating with said projecting hook of said hook member, and said snap slot has a horizontal upper surface for engagement with said shoulder of said snap member.

5. A lid as defined in claim 3 wherein said key member has a handle with a projecting tab, with said key slot of a size to receive said tab while blocking movement of said handle into said key slot.

6. A lid as defined in claim 3 wherein said container has a forward wall with an upper edge and a rearwardly projecting lip at said upper edge, and said lid has a forward wall with a lower edge and a forwardly projecting tab for engaging said lip when said container is closed by said lid.

7. The combination of a lid and a container, said container having an open top with a rear wall having a snap slot and a hook slot, said lid having a latch mechanism with a snap member and a hook member projecting downward for positioning in said snap slot and said hook slot of said container, respectively, when said lid is in position on said container, with a key slot in said lid adjacent said snap and hook members, each of said snap member and said hook member having a cam surface adjacent said key slot for engagement by a key member pushed downward through said key slot to pivot said snap and lock members away from said snap and hook slots, respectively, for removal of said lid from said container.

8. A combination as defined in claim 7 with said hook member having an upward and rearward projecting hook adjacent the lower end of said hook member for entering said container hook slot.

9. A combination as defined in claim 8 with said snap member having a rearward projecting shoulder adjacent the lower end of said snap member for entering said container snap slot.

10. A combination as defined in claim 9 wherein said hook slot has a downward and forward directed upper surface for mating with said projecting hook of said hook member, and said snap slot has a horizontal upper surface for engagement with said shoulder of said snap member.

11. A combination as defined in claim 9 wherein said key has a handle with a projecting tab, with said key slot of a size to receive said tab while blocking movement of said handle into said key slot.

12. A combination as defined in claim 9 wherein said container has a forward wall with an upper edge and a rearwardly projecting lip at said upper edge, and said lid has a forward wall with a lower edge and a forwardly projecting tab for engaging said lip when said container is closed by said lid.

* * * * *

UNITED STATES PATENT AND TRADEMARK OFFICE

CERTIFICATE OF CORRECTION

PATENT NO. : 5,871,113

DATED : February 16, 1999

INVENTOR(S) : Conway, William J., et al.

It is certified that error appears in the above-identified patent and that said Letters Patent is hereby corrected as shown below:

On the title page, Item [73], "Bodrick" should read --Bobrick--.

Signed and Sealed this

Eighth Day of June, 1999

*Attest:*

Q. TODD DICKINSON

*Attesting Officer*

*Acting Commissioner of Patents and Trademarks*